US006030229A

United States Patent [19]

Tsutsui

[11] Patent Number: 6,030,229

[45] Date of Patent: Feb. 29, 2000

[54] ELECTROMAGNETIC DETACHABLE CONNECTOR

[75] Inventor: Yasumitsu Tsutsui, Osaka, Japan

[73] Assignee: Sumitomo Electric Industries, Ltd, Osaka, Japan

[21] Appl. No.: 09/035,461

[22] Filed: Mar. 5, 1998

[30] Foreign Application Priority Data

Mar. 11, 1997 [JP] Japan ..... 9-056260

[51] Int. Cl.[7] ..... H01R 11/30

[52] U.S. Cl. ..... 439/39; 439/38; 336/90

[58] Field of Search ..... 439/39, 38; 336/90

[56] References Cited

U.S. PATENT DOCUMENTS

| | | | |
|---|---|---|---|
| 3,810,258 | 5/1974 | Mathauser | 339/12 |
| 4,118,090 | 10/1978 | Del Mei | 339/12 |
| 4,669,791 | 6/1987 | Savill | 439/34 |
| 4,874,316 | 10/1989 | Kamon et al. | 439/39 |
| 5,401,175 | 3/1995 | Guimond et al. | 439/38 |
| 5,829,987 | 11/1998 | Fritsch et al. | 439/38 |

OTHER PUBLICATIONS

"J. Microeng., vol. 2, pp. 133–140; The LIGA Technique–. . ."

*Primary Examiner*—Paula Bradley

*Assistant Examiner*—Truc Nguyen

*Attorney, Agent, or Firm*—W. F. Fasse; W. G. Fasse

[57] ABSTRACT

An electromagnetic detachable connector includes a pair of female and male connectors. Each of female and male connectors includes a movable section and a fixed section. Each movable section includes a row of terminals that can be connected with those of another movable section, and a guide that can be fitted with that of the another movable section. The fixed sections are relatively fixed so as to have respective movable sections face each other. A permanent magnet and an electromagnet are arranged at a predetermined position of the female and male connectors. Exerting an electromagnetic force on the permanent magnet so that the movable sections move in a direction so as to come closer to or farther away from each other achieves a drive control for connection and disconnection. With this structure, an electromagnetic detachable connector is provided that can control, automatically and with high precision, the connection and disconnection between the female and male connectors.

12 Claims, 9 Drawing Sheets

ELECTROMAGNETIC DETACHABLE CONNECTOR

BACKGROUND OF THE INVENTION

1. Field of the Invention

The present invention relates to electromagnetic detachable connectors for electrical connection between electronic devices, precision apparatuses, medical equipment, and the like including semiconductor devices such as LSIs that have a pair of connectors including a female connector and a male connector connected in a detachable manner by electromagnetic force, or for connection of devices in water, air, at high and low temperatures, and in confined locations. More particularly, the present invention relates to an electromagnetic detachable connector suitable as a microconnector that can be used in the field of micromachines where a connector in the submicron range and having high contact density is required.

2. Description of the Background Art

Reduction in the size of apparatuses has seen significant development these past few years particularly in the field of information communication equipment such as hard discs, CD memories, notebook type personal computers, ink jet printers, and the like. Accordingly, the demand for miniaturization in the wiring portion of these apparatuses is great. Miniaturization of connectors is in progress in memory cards and input/output control cards for notebook type personal computers.

As a technique of producing microminiaturization components, a LIGA process is known in which a series of processes such as X-ray lithography, plating, and molding are carried out. For example, a prototype by MicroParts GmbH (Germany) is described in J. Micromech. Microeng. Vol. 2, p. 133 as an example of a microconnector formed according to the LIGA process.

FIG. 11 is a schematic diagram of the connecting portion of this prototype. An enlargement of a female connector electrode 65 and a male connector electrode 66 of FIG. 11 is shown in FIG. 12. Referring to FIG. 11, this microconnector has female connector electrode 65 and male connector electrode 66 connected by fitting a guide pin 70 (1 mm×2 mm×0.25 mm) on a male connector 68 into a guide hole 69 in a female connector 67, whereby the microconnector is mechanically maintained in a connected state.

In connecting female connector electrode 65 and male connector electrode 66 in a microconnector of the above-described structure, critical alignment is required in the positional registration. The operation of connection/disconnection had to be carried out by direct manipulation by an operator visually using a microscope or externally using a drive device of a particular design. Thus, there was a problem that critical positioning and control of the driving force required for connection/disconnection of the connector are difficult to achieve according to the conventional connection technique of high contact density used in micromachines.

Aiming to solve the above conventional problem, a microconnector is proposed by the same applicant as that of the present invention in U.S. patent application Ser. No. 08/788,889 (filed Jan. 21, 1997). This microconnector maintains terminal connection in the connected state of the connectors by virtue of attraction of a permanent magnet. The structure of this microconnector is shown in FIGS. 12A, 12B, 12C and 12D.

Referring to FIGS. 12B and 12D, a male connector 23 has a plurality of wiring layers 26 formed of deposited conductive materials on a substrate 25. A male connector electrode 24 formed of a conductive material protrudes from one end of wiring layer 26. The leading end of pin electrode 24 is tapered. As shown in FIG. 12B, electrodes 24 are arranged not linearly, but in a two dimensional manner, for example in a matrix, on substrate 25. Respective electrodes 24 are surrounded by a spacer 27.

Referring to FIGS. 12A and 12C, a female connector 15 has a plurality of wiring layers 18 formed of deposited conductive materials on a substrate 17. A female connector electrode 16 is formed at each one end of wiring layer 18. Female connector electrodes 16 formed of a conductive material are arranged in a two dimensional manner, for example in a matrix, so as to correspond to pin electrodes 24 shown in FIG. 12B. Each female connector electrode 16 has a hole 16a to receive pin electrode 24 for electrical connection. Female connector electrode 16 is surrounded by a spacer 19.

Male connector 23 of FIG. 12B and female connector 15 of FIG. 12A are electrically connected by overlaying the plane of substrates 25 and 17 where respective electrodes are formed so as to face each other. Here, positioning of male connector electrode 24 and female connector electrode 16 is implemented by aligning a magnetic layer 28 provided on male connector 23 with a magnetic layer 20 provided on female connector 15. Magnetic layers 28 and 20 each forming a permanent magnet attract each other to join the connectors.

In the above microconnector employing the attraction of a permanent magnet, the attraction between the permanent magnets is significantly reduced with increasing distance therebetween. Although the connection between the female connector and the male connector can be maintained, attraction of a sufficient level is not generated between the permanent magnets to move the female and male connectors unless they are close enough to each other for achieving the required magnetic attraction when the connectors are moved closer or farther away from each other. It was not possible to take advantage of the attraction of the permanent magnet at greater distances. As a result, manual operation was required. In the environment where direct manual operation was not available, it was difficult to carry out the connection/disconnection operation.

There was also a problem that a rather high force had to be exerted externally for detaching the female and male connectors from each other by overcoming the great attraction between the permanent magnets of the connected female connector and male connector.

SUMMARY OF THE INVENTION

In view of the foregoing, an object of the present invention is to provide an electromagnetic detachable connector in which the connection and disconnection of a female connector and a male connector is controllable automatically and with high precision.

To achieve the above object, an electromagnetic detachable connector according to an aspect of the present invention includes a female connector and a male connector forming a pair, wherein each female and male connector respectively has a movable section and a fixed section. Each movable section has a row of terminals that can be connected to each other row of terminals, and a guide that can be fitted to each other guide. The connector has each fixed section held in a relatively fixed manner with respect to each other fixed section while the movable sections face each other. At least one of the female connector and the male connector forming a pair includes a permanent magnet that is magnetized in a predetermined direction, and an electromagnet. The movable section of the female or male connector where the permanent magnet and the electromagnet are arranged is driven in a direction so as to move closer to or farther away from the other movable section by the electromagnetic force of the electromagnet acting on the permanent magnet, whereby connection/disconnection of the movable sections is effected.

In the electromagnetic detachable connector of the present invention, current is conducted to the electromagnet so that an electromagnetic force is exerted on the permanent magnet in the direction of moving the movable sections closer to or farther away from each other, whereby the drive for the relative movement of the movable sections can be implemented without manual operation. The driving force can be fine-tuned in a relatively easy manner by conducting a current in a pulsed manner, for example, to the electromagnet. A great movement stroke of the movable section can be ensured in comparison to the case in which only attraction by the permanent magnet is employed.

In a preferable embodiment of the electromagnetic detachable connector of the present invention, a movable section of at least one of the female and male connectors has a permanent magnet magnetized in a predetermined direction. An electromagnet is fixed so as to surround the permanent magnet at the fixed section of the female or male connector having the permanent magnet arranged at the movable section. By driving the movable sections with each other by exerting electromagnetic force of the electromagnet on the permanent magnet, the female connector and male connector are connected/disconnected with respect to each other.

With the above-described structure, an electromagnetic force is exerted on the permanent magnet caused by the magnetic flux generated where the permanent magnet is positioned at the inner side of the electromagnet by a predetermined current conducted to the electromagnet. Therefore, a driving force originated from the electromagnet can be efficiently applied to the permanent magnet. As a result, a greater stroke for the connection/disconnection of the connector can be ensured and adjustment of the driving force can be implemented more easily.

According to another preferable embodiment of the electromagnetic detachable connector of the present invention, a cylindrical container having an inner space longer than the permanent magnet in the direction of the relative movement of the movable section, and having both ends in this direction closed is fixed at the movable section of the female or male connector having the permanent magnet. Each permanent magnet is slidable in the direction of the axis within the inner space of the cylindrical container.

By the above-described structure, the distance between the permanent magnets in the cylindrical container can be increased by the electromagnetic force of the electromagnet without altering the relative position between the movable sections in detaching the female and male connectors from their connected state. Therefore, the attracting force between the male and female connectors can be greatly reduced while maintaining the connected state of the female and male connectors. As a result, detachment therebetween can be facilitated.

According to a further preferable embodiment of the electromagnetic detachable connector of the present invention, a permanent magnet magnetized in a direction generating attraction with respect to each other is arranged in each movable section of the pair of female and male connectors. The connection between the movable sections can be maintained by the attraction between respective permanent magnets.

The present invention includes an electromagnetic detachable connector having a structure in which an electromagnet is fixed at the movable section of at least one of the female connector and male connector forming a pair. The electromagnet has a coil wound around an iron core. Also, an annular permanent magnet arranged to surround the coil and substantially coaxial with the iron core is fixed at the fixed section of the female or male connector having the movable section to which the electromagnet is fixed.

In the above structure, a current flow of a predetermined level applied to the electromagnet generates a magnetic flux at the position where the permanent magnet surrounding the electromagnet is located, whereby an electromagnetic force acts on the permanent magnet. Therefore, a driving force originating from the electromagnet can be exerted efficiently to the permanent magnet. As a result, a greater stroke for the detachment of the connector can be ensured. Also, adjustment of the driving force can be carried out more easily.

The electromagnetic detachable connector of this structure preferably has the annular permanent magnet magnetized in the radial direction of the center axis of the iron core.

In a more preferable embodiment of the electromagnetic detachable connector of this structure, an electromagnet is fixed to the movable section of both the female and male connectors. The electromagnet has a counterpart rod iron core arranged substantially in a coaxial manner, and a coil wound around the iron core. A pair of annular permanent magnets arranged so as to surround the coil of each electromagnet are fixed at the fixed sections of both the female and male connectors. The permanent magnets forming a pair are magnetized in opposite directions. The magnetic flux from the permanent magnet is concentrated within the iron cores forming a pair to cause attraction between the iron cores forming a pair. As a result, the connection between the movable sections is maintained.

In a still further preferable embodiment of the present invention, the electromagnetic detachable connector further includes a resilient bias applying unit for exerting a bias on the movable section in a direction releasing the connection between the movable sections. The provision of such a resilient bias applying unit allows a reduction in the electromagnetic force to be exerted on the electromagnet that is required for moving the movable sections into a detached state from a connected state. As a result, the connection and disconnection of the connectors can be facilitated.

In the electromagnetic detachable connector of the present invention, the drive for the relative movement between the movable sections can be implemented without using a manual operation by virtue of the electromagnetic force of the electromagnet exerted on the permanent magnet. The driving force can be fine-tuned in a relatively easy manner. Also, a great motion stroke of the movable sections can be ensured in comparison to the case where only the attraction of a permanent magnet is employed. The connector of the present invention is expected to provide a significant advantage when applied to a microconnector such as in the field of micromachines. The advantage of the present invention is exhibited irrespective of the size of the connector per se to which the present invention is applied. A similar effect can be achieved when applied to a connector other than a microconnector.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 5A and 5B are sectional views of connector B of FIG. 2 for describing a detachment operation, wherein FIG. 5A shows a connected state and FIG. 5B shows the initiation of a disconnecting operation from the connected state.

DESCRIPTION OF THE PREFERRED EMBODIMENTS

Embodiments of the present invention will be described hereinafter with reference to the drawings.

Figure 1:
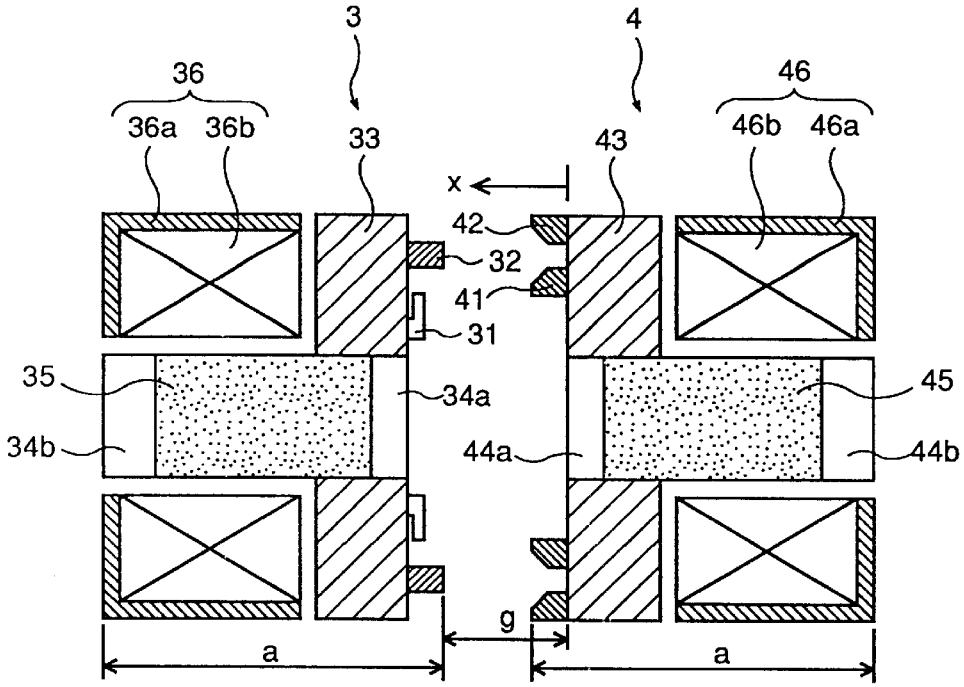
FIGS. 1, 2, and 3 are sectional views of electromagnetic detachable connectors A, B, and C, respectively, according to first, second, and third embodiments, respectively, of the present invention, with female and male connectors detached from each other.

Referring to FIG. 1, an electromagnetic detachable connector according to a first embodiment of the present invention (referred to as "connector A" hereinafter) includes a female connector 3 and a male connector 4. Respective terminal substrates 33 and 43 of female and male connectors 3 and 4 having respective terminals 31 and 41 and guides 32 and 42 provided in a circular manner are arranged facing each other. Cylindrical permanent magnets 35 and 45 are fixed to terminal substrates 33 and 34, respectively, sandwiched between spacers 34*a*, 44*a* and spacers 34*b*, 44*b*.

Female connector 3 and male connector 4 include electromagnets 36 and 46, respectively. Electromagnets 36 and 46 include annular iron cores 36*a* and 46*a*, respectively, provided so as to enclose about permanent magnets 35 and 45, and exciting coils 36*b* and 46*b*, respectively. Electromagnets 36 and 46 are relatively fixed to form the fixed section of the female and male connectors of the present invention. Terminal substrates 33 and 43 and permanent magnets 35 and 45 are maintained relatively movable with respect to the direction of the center axis of electromagnets 36 and 46, i.e., in the x axis direction shown in FIG. 1, to form the movable section of the female and male connectors of the present invention. Permanent magnets 35 and 45 are magnetized so as to attract each other in the direction of the center axis thereof.

Connector A of the above structure operates as set forth in the following. In the state where female and male connectors 3 and 4 are detached as shown in FIG. 1, a predetermined current is conducted to exciting coils 36*b* and 46*b* of electromagnets 36 and 46 so that permanent magnets 35 and 45 forming a pair receive an electromagnetic force that urges the magnets 35 and 45 in a direction approximating each other, i.e. moving toward each other. Permanent magnets 35 and 45 gradually move closer to each other so that female connector 3 and male connector 4 are eventually joined. In this state, the distance between permanent magnets 35 and 45 is extremely small. Therefore, the connection between female and male connectors 3 and 4 can be maintained stably by the attraction between permanent magnets 35 and 45 per se even after the exciting current to electromagnets 36 and 46 is turned off.

When female and male connectors 3 and 4 that are in a connected state are to be detached, a predetermined exciting current is conducted to exciting coils 36*b* and 46*b* of electromagnets 36 and 46 so that the pair of permanent magnets 35 and 45 receive an electromagnetic force urging the magnets 35 and 45 in a direction moving farther away from each other. As a result, permanent magnets 35 and 45 are driven so as to become remote from each other, whereby the connection between female and male connectors 3 and 4 is eventually released. In this state, the distance between permanent magnets 35 and 45 is relatively great, so that the attraction between permanent magnets 35 and 45 per se is extremely reduced. The detached state of female connector 3 and male connector 4 is maintained stably even after the exciting current to electromagnets 36 and 46 is cut off.

The driving force and driving stroke for detachment of female and male connectors 3 and 4 can be adjusted by altering the exciting current applied to electromagnets 36 and 46, or by appropriately altering the length of permanent magnets 35 and 45. For example, in the case where female connector 3 is embodied without both the permanent magnet 35 and the electromagnet 36, a driving stroke sufficient for connection/disconnection can be achieved by only the excitation of electromagnet 46 of male connector 4 by ensuring a sufficient length in the axial direction of permanent magnet 45 and electromagnet 46 of male connector 4.

Figure 2:
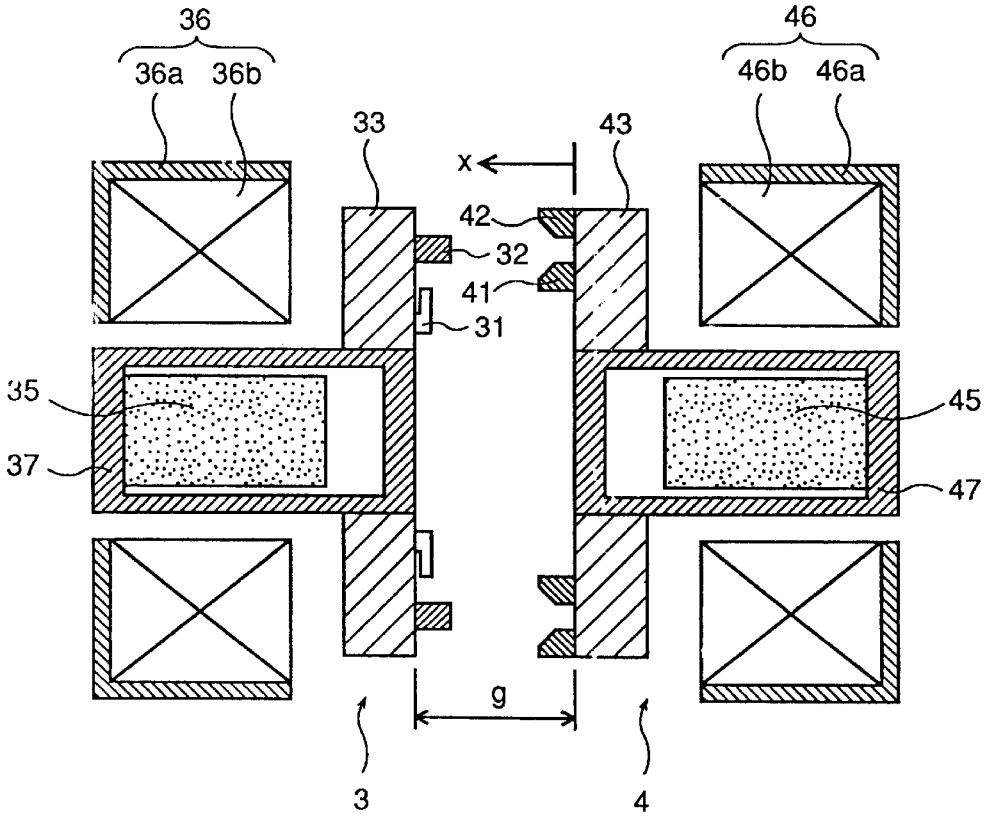

An electromagnetic detachable connector according to a second embodiment of the present invention (referred to as "connector B" hereinafter) will be described hereinafter with reference to FIG. 2. As shown in FIG. 2, connector B is similar to connector A of the first embodiment in that terminal substrates 33, 43, permanent magnets 35, 45, and electromagnets 36 and 46 are provided. The direction of magnetization of permanent magnets 35 and 45 is also identical to that of connector A. Connector B differs from connector A in that permanent magnets 35 and 45 are provided in a slidable manner within a cylindrical space in cylindrical containers 37 and 47 having a columnar space longer than the length of permanent magnets 35 and 45 in the axial direction, and having both ends closed.

Figure 5A:
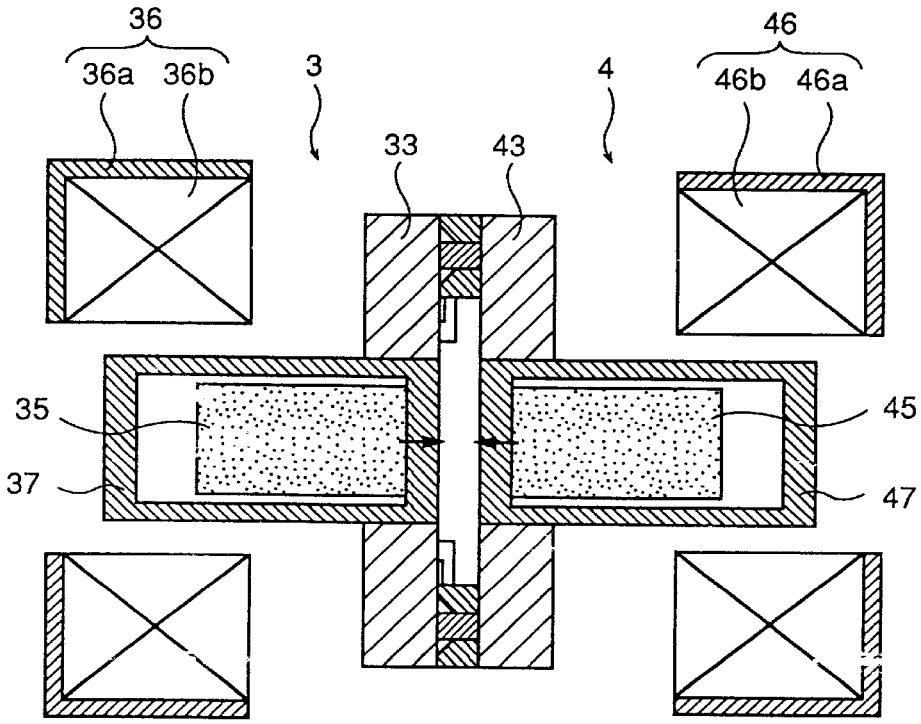
Figure 5B:
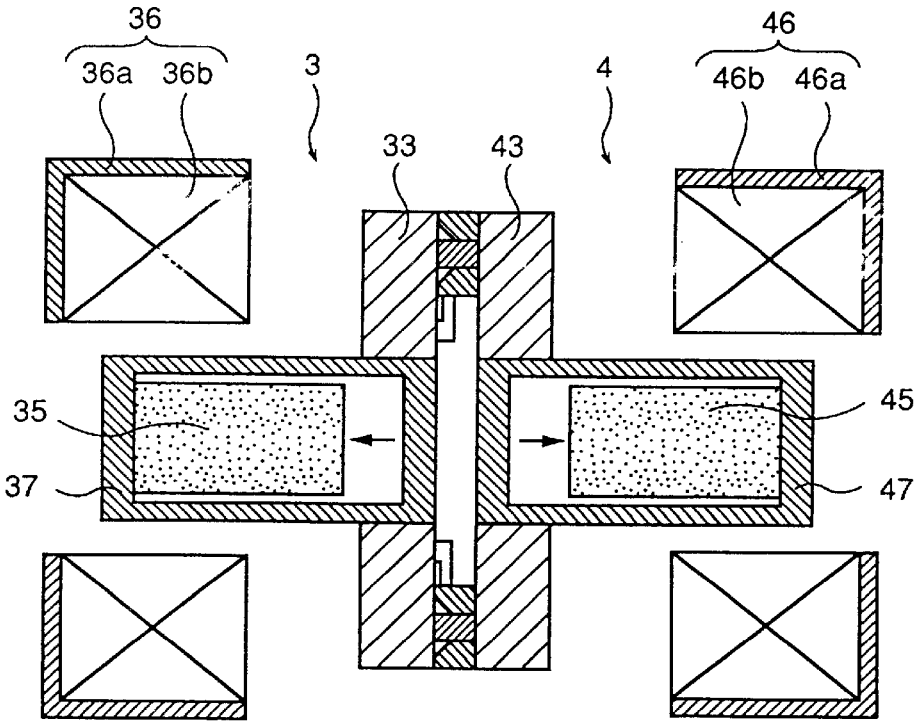

The operation of connector B will be described hereinafter with reference to FIGS. 5*a* and 5B. When electromagnet 46 of male connector 4, for example, is excited in the disconnected state shown in FIG. 2, electromagnetic force is exerted on permanent magnet 45. Permanent magnet 45 slides toward female connector 3 in the columnar space in cylindrical container 47 to abut against the closed end of cylindrical container 47 at the female connector 3 side. As a result, cylindrical container 47 is urged toward female connector 3, so that the distance between terminal substrates 33 and 43 of female connector 3 and male connector 4, respectively, becomes smaller. In response, the attraction due to the magnetic force of permanent magnets 35 and 45 per se becomes greater. Terminals 31 and 41 are joined with each other as shown in FIG. 5A. The connected state is maintained by the attraction between permanent magnets 35 and 45.

When electromagnets 36 and 46 are excited so that an electromagnetic force is exerted in a direction to urge permanent magnets 35 and 45 to move farther away from each other from the joined state, permanent magnets 35 and 45 promptly slide within cylindrical containers 37 and 47 in a direction remote from each other. Thus, the distance between permanent magnets 35 and 45 is increased as shown in FIG. 5B. A greater distance between permanent magnets 35 and 45 causes significant reduction in the attraction between permanent magnets 35 and 45. Therefore, terminals 31 and 41 can easily be detached from each other.

Figure 3:
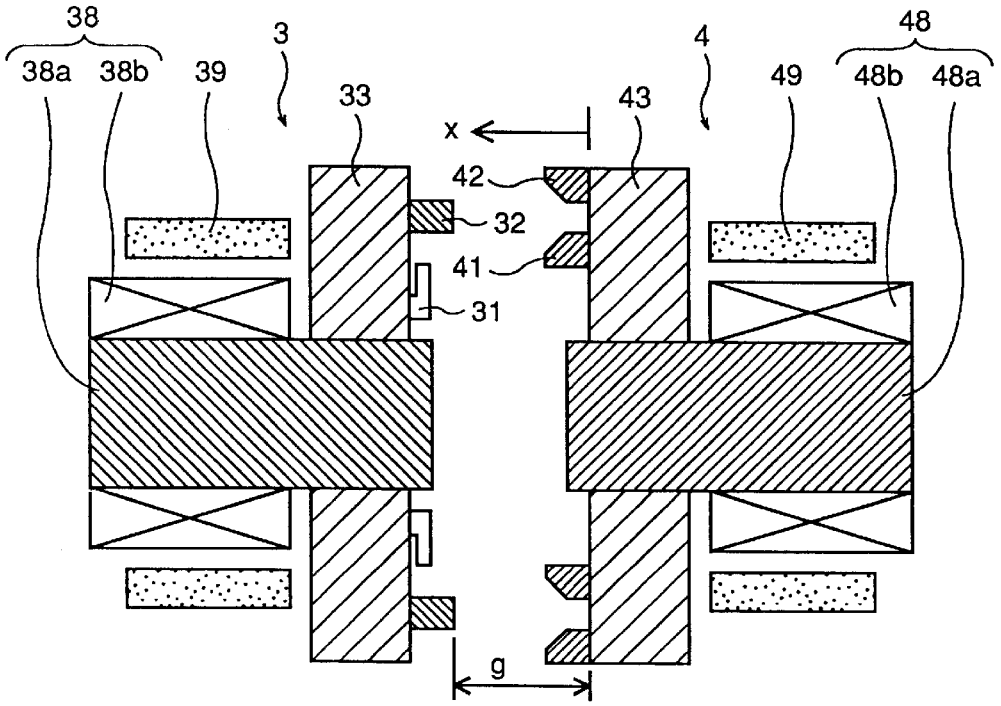

An electromagnetic detachable connector according to a third embodiment of the present invention (referred to as "connector C" hereinafter) will be described with reference to FIG. 3. As shown in FIG. 3, connector C is similar to connectors A and B in that terminal substrates 33 and 43 are provided, and that connection/disconnection of female and male connectors 3 and 4 is implemented by the electromagnetic force acting between electromagnets 38 and 48 and permanent magnets 39 and 49. Connector C differs from connectors A and B in that a structure is provided in which rod iron cores 38*a* and 48*a* are fixedly fitted in respective holes provided at the center of terminal substrates 33 and 43 with exciting coils 38B and 48B wound around the cores to form electromagnets 38 and 48, and a pair of annular permanent magnets 39 and 49 are arranged in a manner fixed with respect to each other so as to surround exciting coils 38*b* and 48*b*. More specifically, electromagnets 38 and 48 are arranged at respective movable sections of female connector 3 and male connector 4, and permanent magnets 39 and 49 are arranged at respective fixed sections.

According to the present embodiment, conduction of a predetermined exciting current to electromagnets 38 and 48 causes relative electromagnetic force in the direction of the center axis between electromagnets 38 and 48 and permanent magnets 39 and 49. As a result, electromagnets 38 and 48 of the movable sections are driven in a direction moving closer to or farther away from each other. Thus, the connection/disconnection operation of female connector 3 and male connector 4 can be carried out in a manner like connectors A and B.

In the present embodiment, the direction of magnetization of permanent magnets 39 and 49 is preferably set in the radial direction, i.e. in a direction extending radially from the center axis of iron cores 38*a* and 48*a*. Also, permanent magnets 39 and 49 are preferably magnetized in the radial and opposite directions so as to maintain the connection between female connector 3 and male connector 4 by the attraction of each permanent magnet. By magnetizing permanent magnets 39 and 49 as described above, the joined state of female and male connectors 3 and 4 is maintained with the connection of the movable sections, not only by the attraction of permanent magnets 39 and 49, but also by the attraction generated between iron cores 38*a* and 48*a* caused by concentration of the magnetic flux from permanent magnets 39 and 49 at the pair of iron cores 38*a* and 48*a*.

Figure 4:
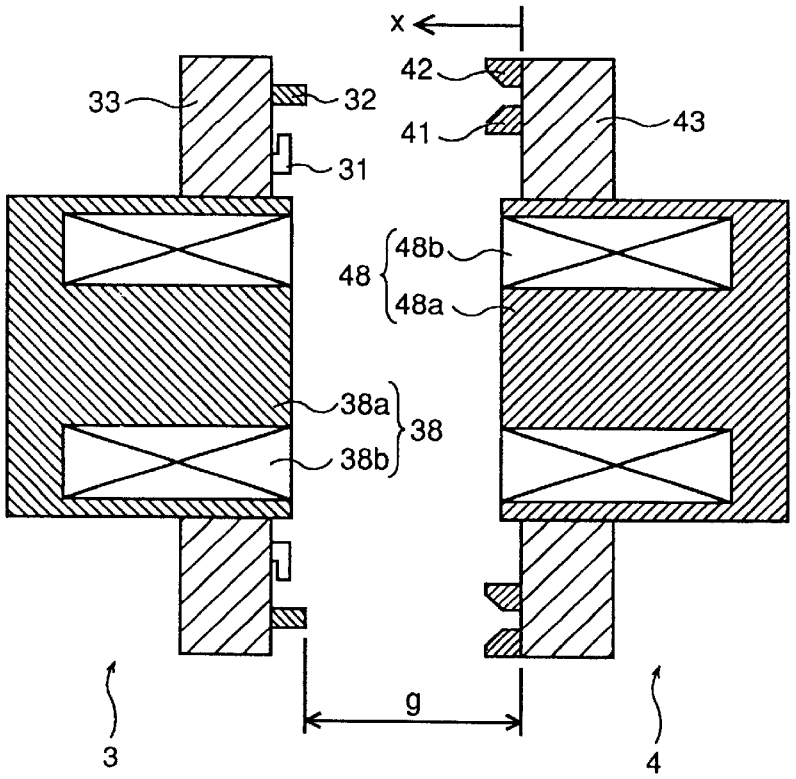
FIG. 4 is a sectional view of a comparative electromagnetic detachable connector D without a permanent magnet, with female and male connectors detached from each other.

The advantage of the present invention is demonstrated by a comparison of the detaching property due to respective electromagnetic force of connectors A–C with that of the comparative example of connector D of FIG. 4. The comparative connector of FIG. 4 has a structure in which electromagnets 38 and 48 including iron cores 38*a* and 48*a* and exciting coils 38*b* and 48*b* are fixedly fitted in respective holes provided at the center of terminal substrates 33 and 43 to form the movable sections of female connector 3 and male connector 4. The fixed section side that is not illustrated does not include a permanent magnet.

The particular dimension specifications of connectors A–D used in the experiment, the magnetic property of each permanent magnet, and the exciting current applied to each electromagnet are shown in the following Table 1.

TABLE 1

Specifications of Connectors A–D

| | Type of Connector | | | |
|---|---|---|---|---|
| | A | B | C | D |
| Permanent Magnet | | | | |
| Length in axial direction (mm) | 1.9 | 1.125 | 0.8 | — |
| Diameter (mm) | 0.7 | 0.6 | 0.7 | — |
| Maximum accumulated energy ($kJ/m^3$) | Approx. 200 | Approx. 240 | Approx. 50 | — |
| Magnetization (kA/m) | 800 | 880 | 400 | — |
| Electromagnet | | | | |
| Length in axial direction (mm) | 1.1 | 1.1 | 1.0 | 1.6 |
| Outer diameter (mm) | 2.3 | 3.0 | 1.4 | 1.9 |
| Inner diameter (mm) | 0.9 | 1.2 | — | — |
| Wound number of coils | 900 | 1200 | 525 | 900 |
| Exciting current · voltage | 80 mA, 20 V | 80 mA, 38 V | 80 mA, 9 V | 78 mA, 17 V |
| Length of inner space of cylindrical container (mm) | — | 1.45 | — | — |

Figure 6:
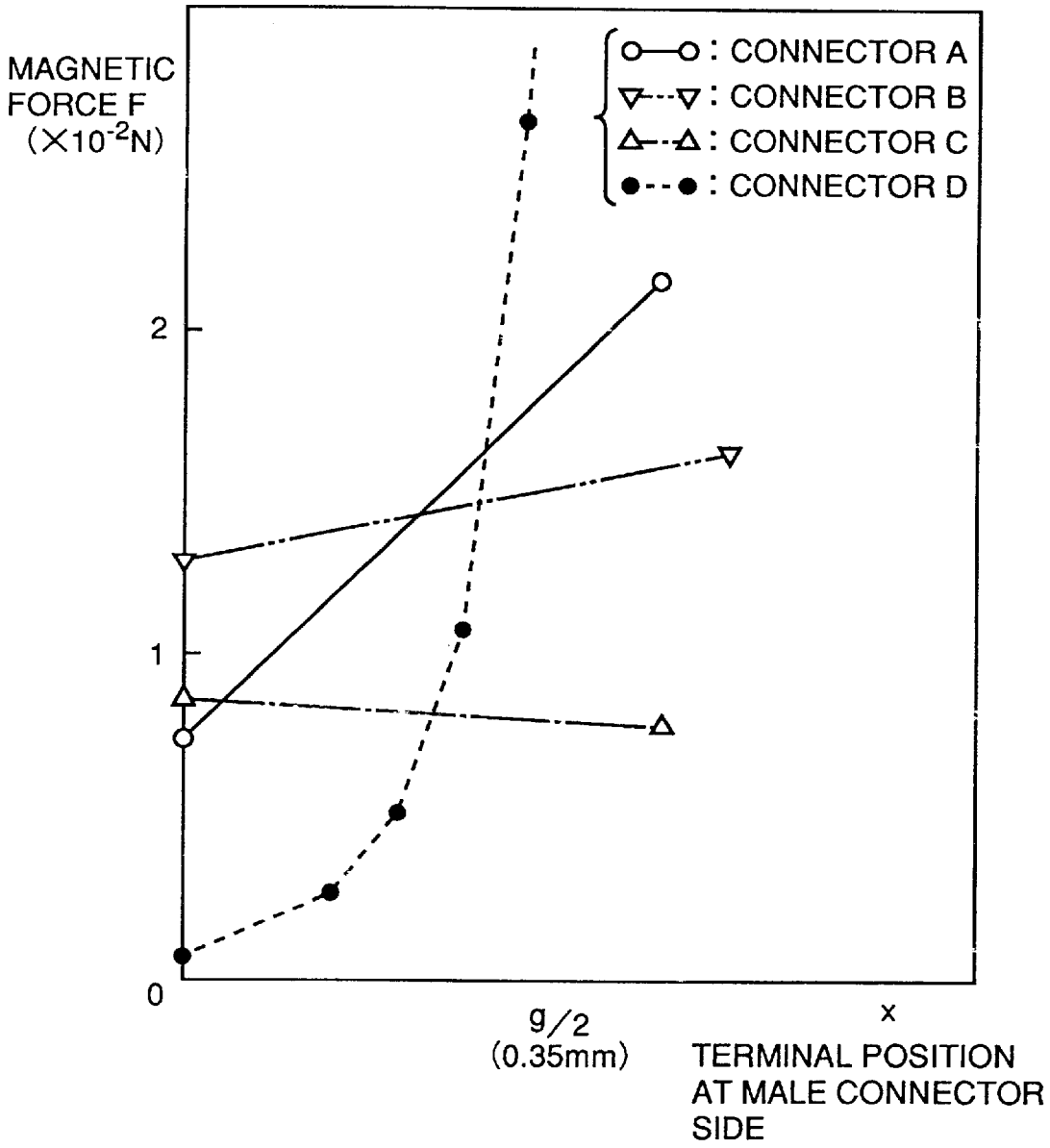
FIG. 6 is a graph showing actually measured results of the relationship between a terminal position x at the male connector side and magnetic force F that drives the terminal of the male connector side toward the female connector when an exciting current is applied to the electromagnet of the male connector part of connectors A–D.

The actual measurements of the electromagnetic force for driving the terminal of a male connector when the electromagnet of the male connector part is excited under the conditions of Table 1 are shown in the graph of FIG. 6. Referring to FIG. 6, the terminal position x of male connector 4 is plotted along the abscissa, and the electromagnetic force F for driving the terminal of male connector 4 is plotted along the ordinate. The value of x corresponding to the terminal position of male connector 4 indicates the farthest position from female connector 3 at x=0. A greater value of x mean that the male and female connectors are approaching each other. Also, "g" indicates the distance (initial gap) between the leading end of guide 32 of female connector 3 and the surface of terminal substrate 43 of male connector 4 when female and male connectors 3 and 4 are at the most remote state. In the graph of FIG. 6, x=g/2 means that the movable section of male connector 4 is located at a position approaching female connector 3 by a distance of half the initial gap g due to the excitation of the electromagnet. The distance g of connectors A–D used in the present experiment is 0.7 mm. Therefore, x=g/2 corresponds to the position of x=0.35 mm.

It is appreciated from the graph of FIG. 6 that, in connector D which is a comparative example, the generated magnetic force is extremely small at the initial position (x=0) where the distance between female connector 3 and male connector 4 is greatest. In contrast, a relatively great magnetic force is generated at the same initial position in connectors A–C of the present invention. Therefore, by using connectors A–C, the range of the stroke that allows connection/disconnection of the terminals can be set relatively larger than that using connector D.

Figure 7:
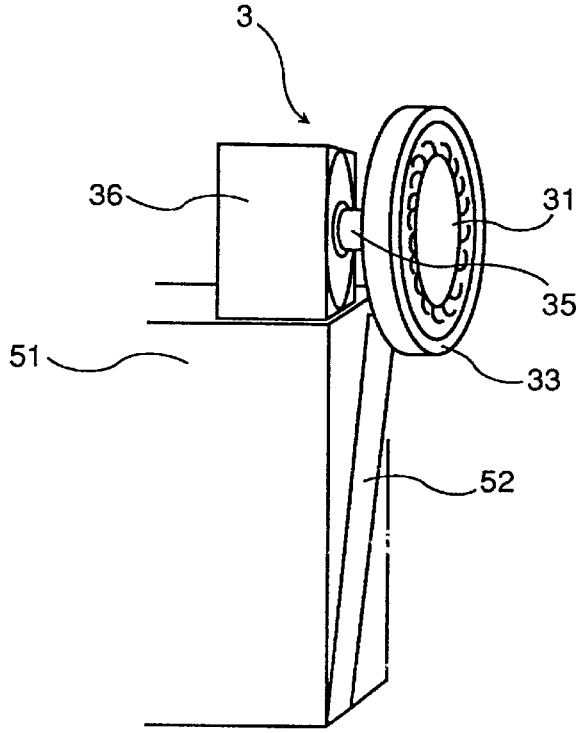
FIG. 7 is a perspective view showing an example of a structure in which a fixed section including the electromagnet and a movable section including the terminal substrate and the permanent magnet of the female connector of connector A of FIG. 1 are maintained in a relative manner via a leaf spring.

FIG. 7 shows an embodiment for maintaining the relative position between the movable section side and the fixed section side of female connector 3 of connector A as an example. Here, electromagnet 36 of the fixed portion is fastened on a fix base 51. The movable section including terminal substrate 33 and permanent magnet 35 is attached to one end of a leaf spring 52. The other end of leaf spring 52 is fixed below fix base 51. By implementing the relative holding between the movable section side and the fixed section side via leaf spring 52, the detachment operation of the connectors can be carried out more easily by virtue of the restoring force of leaf spring 52 that acts in a direction for detachment of the connectors from the joined state. The operability of connection/disconnection can be improved by adjusting the resilience of leaf spring 52, the magnetic force, and the force required for inserting or pulling out the terminals with respect to each other. The present invention is not limited to the usage of a leaf spring as the means for applying a resilient urging force for the relative holding between the movable section side and the fixed section side. Other resilient members such as a coil spring can be interposed to implement a similar advantage.

Figure 8:
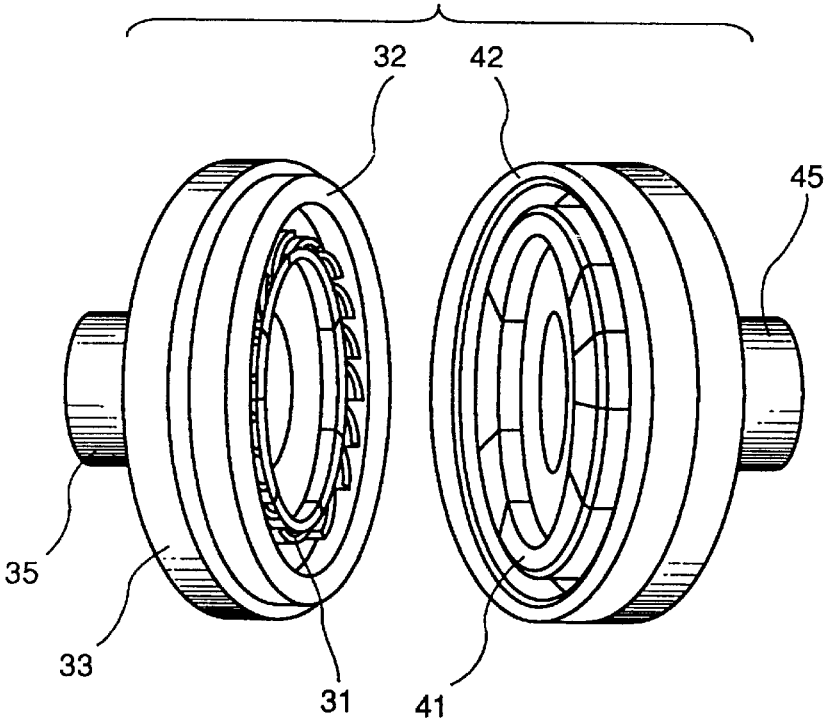
FIG. 8 is a perspective view of connector A of FIG. 1 wherein movable sections including the terminal substrate and the permanent magnet of both the female connector and the male connector face each other in a detached state.

The terminal structure is shown in FIG. 8, which is a perspective view of only the counterpart movable section of connector A. A row of terminals arranged in a circular manner within respective connecting planes of the female and male connectors are surrounded by a cylindrical guide that is coaxial. A magnet is arranged at the center of the plane. The alignment margin is increased by this structure. As a result, connection/disconnection can be carried out more easily.

Connectors A–C do not necessarily have to include a magnet structure in which the female connector 3 side is similar to the male connector 4 side. A structure where a row of terminals and a guide are simply provided on a terminal substrate as the fixed section can be adapted. Also, both female and male connectors 3 and 4 do not have to have a substantially symmetric structure about the axis as in the above embodiments of the present invention. The present invention is applicable to a structure other than an axial symmetrical one as long as the structure has the electromagnet of the fixed section surround the rod-shaped permanent magnet attached to the movable section or has the permanent magnet in a configuration surrounding the electromagnet attached to the movable section mounted to the fixed section. Furthermore, by appropriately altering the length of the rod-like or annular permanent magnet, the driving stroke for connection/disconnection can be adjusted according to the initial gap g between the female and male connectors.

When the connector of the above embodiments is applied to the connector of submicron multipins such as a micromachine connector, the usage of the LIGA process described in the section of the background art is effective in forming a row of terminals and a guide on the terminal substrate.

Figure 9A:
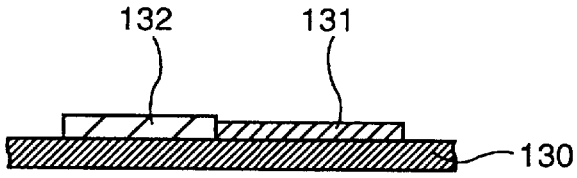
FIGS. 9A, 9B, 9C, 9D, 9E and 9F are enlarged sectional views of only the terminal portion of a female connector of respective embodiments of FIGS. 1–3, representing successive fabrication process by LIGA.
Figure 9B:
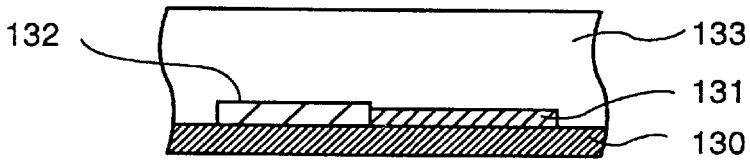
Figure 9C:
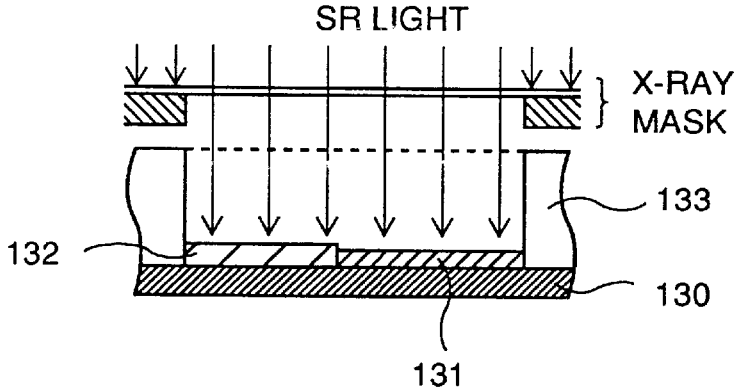
Figure 9D:
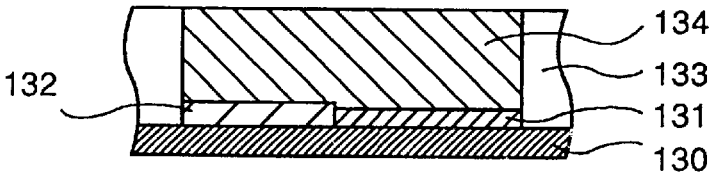
Figure 9E:
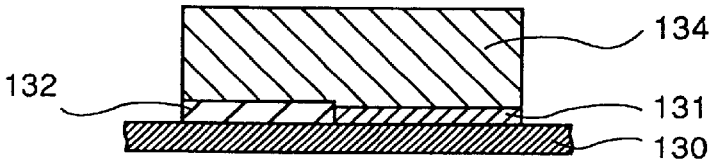
Figure 9F:
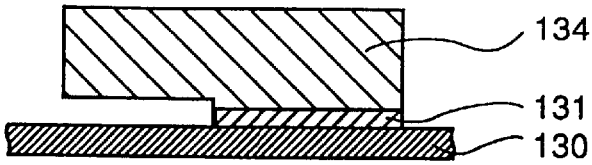

FIGS. 9A–9F show a specific example of the fabrication process of a female connector according to the LIGA method, showing only the enlarged terminal portion. Similar to a male connector, fabrication of a fixed electrode is carried out by the processes of formation of an adhesion layer on a substrate, application of a resist, Synchrotron Radiation (SR) lithography, and plating. The same applies for the stopper and wiring. Therefore, the formation of a spring electrode is particularly shown in the figure. Referring to FIG. 9A, the pattern of an adhesion layer 131 and a sacrificial layer 132 is formed on a substrate 130. A sacrificial layer is the layer that is to be removed by wet etching at the last step of the process. For example, a sacrificial layer is formed of titanium or copper. Referring to FIG. 9B, a resist 133 is applied on substrate 130. SR lithography and then development are carried out to result in the resist pattern shown in FIG. 9C. This pattern has a configuration corresponding to the terminal of a female connector. Referring to FIG. 9D, nickel plating is effected. Then, the surface of the deposited nickel 134 is polished. By removing sacrificial layer 132 by wet etching after the resist is removed as shown in FIG. 9E, a structure is obtained in which a portion of nickel 134 attains a floating state spaced from substrate 130 as shown in FIG. 9F. This floating portion functions as the spring portion of the terminal electrode. When the sacrificial layer is formed of titanium or copper, hydrofluoric acid or hydrochloric acid are used, respectively, for wet etching. Then, a permanent magnet is attached on the substrate. Thus, a female connector is completed.

Figure 10A:
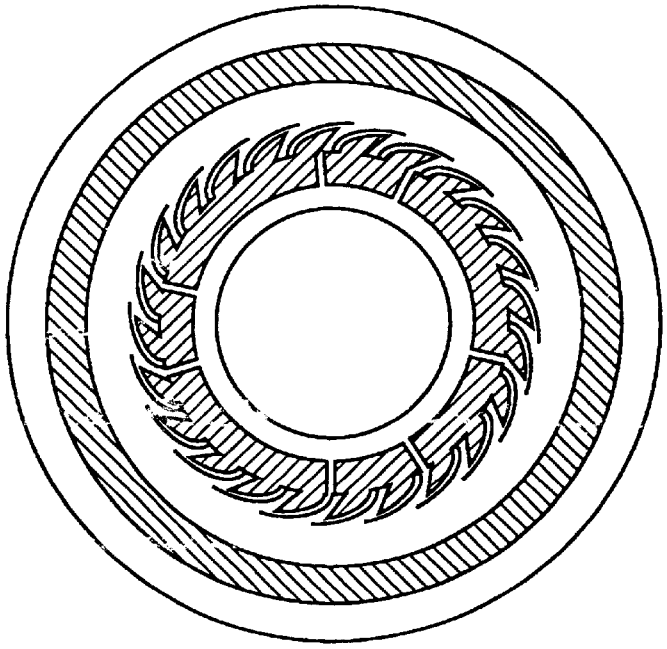
FIGS. 10A and 10B show X-ray masks used to form the row of terminals and the guide of the connector of FIG. 8 according to the LIGA process of FIGS. 9A–9F, directed to a female type connector and a male type connector, respectively.
Figure 10B:
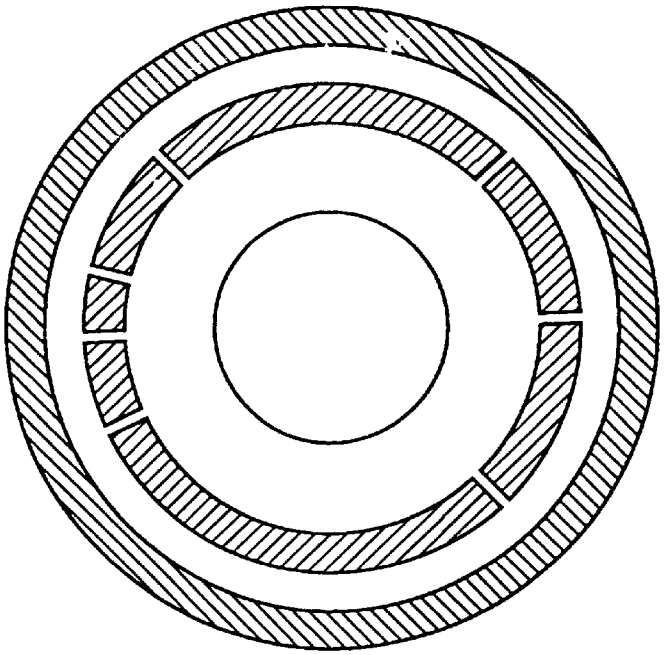
Figure 11A:
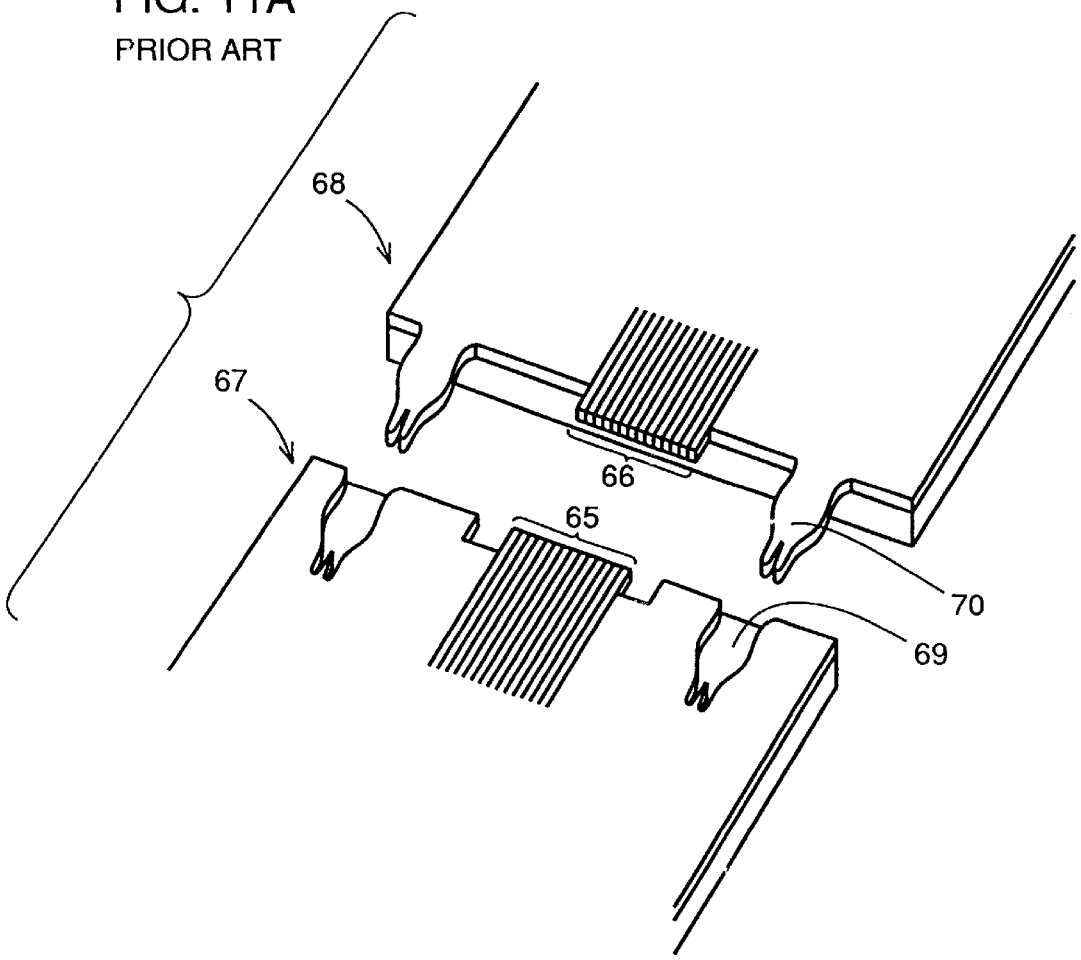
FIG. 11A PRIOR ART
FIG. 11A is a perspective view of the area of the connection portions of female and male connectors of a conventional microconnector fabricated by LIGA.
Figure 11B:
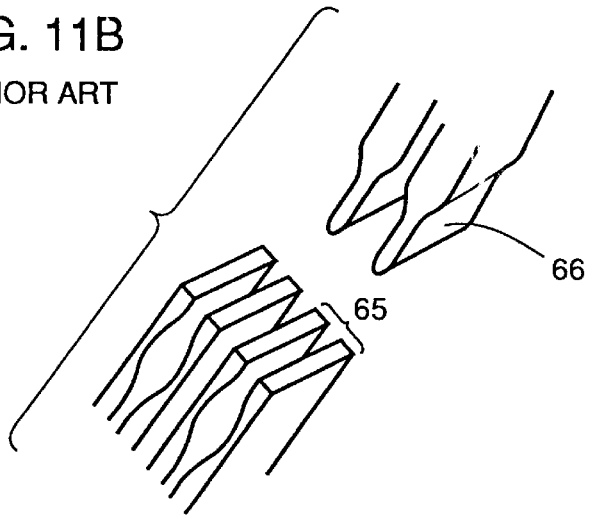
FIG. 11B PRIOR ART
FIG. 11B is a perspective view of the area of the connection of male and female connector electrodes of FIG. 11A shown in an enlarged manner.
Figure 12A:
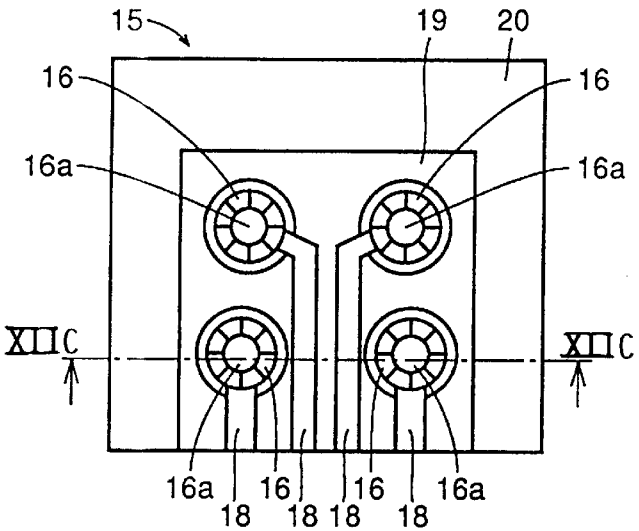
FIGS. 12A and 12B are plan views showing female and male connectors of the microconnector proposed in U.S. patent application Ser. No. 8/788,889 by the same applicant as the present application.
Figure 12B:
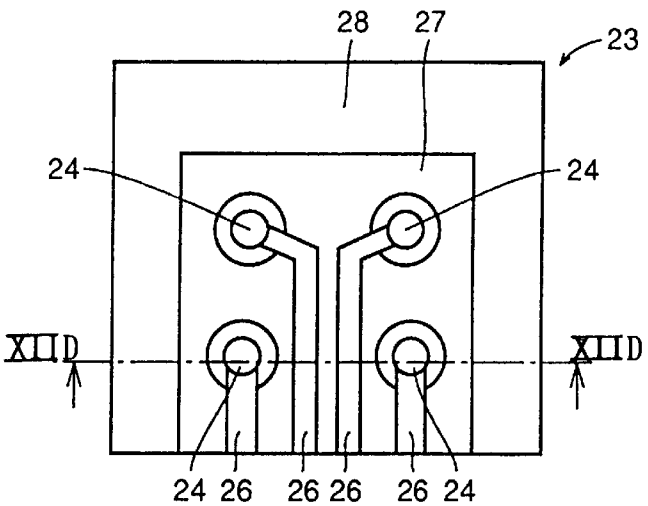
Figure 12C:
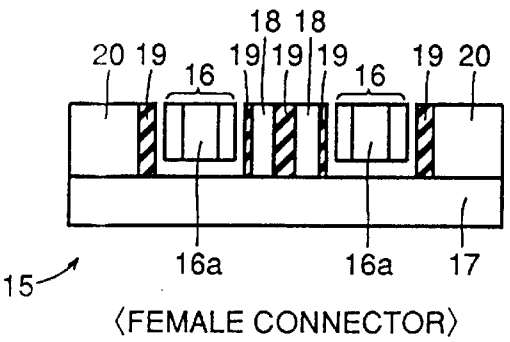
FIG. 12C is a sectional view taken along line XIIC—XIIC of FIG. 12A.
Figure 12D:
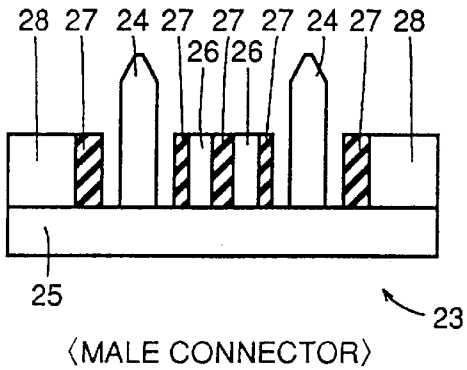
FIG. 12D is a sectional view taken along line XIID—XIID of FIG. 12B.

An X-ray mask used in the SR lithography step of FIG. 9B is shown in FIG. 10A. FIG. 10B shows an X-ray mask used in the formation of a row of terminals and the guide at the male connector side. In FIGS. 10A and 10B, the shaded region corresponds to only the supporting layer of the mask, and the remaining regions correspond to the portion including the X-ray absorption layer. The region of the absorption layer does not allow transmission of an X-ray. A desired resist pattern is formed by the passage of the X-ray only through the supporting layer portion. By the LIGA method, a resist structure can be formed of a fine and high aspect ratio with deep X-ray lithography. By providing plating of a thick film thereon, a metal structural body is obtained. This metal structural body can be used directly as a terminal or guide structure. Also, the metal structural body can be used as a die for resin molding, and then the resin mold can be plated to form a train of terminals and guide structure.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electromagnetic detachable connector arrangement comprising a female connector and a male connector forming a pair, wherein each of said connectors includes a movable section and a fixed section, each said movable section has a row of terminals that is connectable with said row of terminals of said movable section of the other one of said connectors and a guide that is fittable with said guide of said movable section of the other one of said connectors, each said fixed section is held in a relatively fixed manner with respect to said fixed section of the other one of said connectors while said movable sections of said connectors face each other, a first one of said female connector and said male connector further includes a first permanent magnet magnetized in a predetermined direction and a first electromagnet, and said connectors are so adapted and arranged that connection and disconnection of said movable sections of said connectors with respect to each other are carried out by said movable section of said first one of said connectors being driven so as to move relatively closer to or farther from said movable section of the other one of said connectors due to an electromagnetic force of said electromagnet acting on said permanent magnet.

2. The electromagnetic detachable connector arrangement according to claim 1, wherein said permanent magnet is arranged on said movable section of said first one of said connectors, and said electromagnet is fixed on said fixed section of said first one of said connectors so as to surround said permanent magnet.

3. The electromagnetic detachable connector arrangement according to claim 2, further comprising a cylindrical container fixed to said movable section having said permanent magnet arranged thereon, wherein said cylindrical container has therein an inner space longer than said permanent magnet in a direction of relative movement of said movable section, and has two closed ends bounding said inner space in said direction, and wherein said permanent magnet is arranged to be slidable in an axial direction within said inner space of said cylindrical container.

4. The electromagnetic detachable connector arrangement according to claim 3, wherein a second one of said connectors other than said first connector further includes a second permanent magnet arranged on said movable section thereof, and each said permanent magnet is magnetized in a direction so as to generate a magnetic attraction therebetween.

5. The electromagnetic detachable connector arrangement according to claim 2, wherein a second one of said connectors other than said first connector further includes a second permanent magnet arranged on said movable section thereof, and each said permanent magnet is magnetized in a direction so as to generate a magnetic attraction therebetween.

6. The electromagnetic detachable connector arrangement according to claim 1, wherein said first electromagnet comprises a coil wound around an iron core and is fixed to said movable section of said first one of said connectors, and said first permanent magnet comprises an annular permanent magnet that is arranged so as to surround said coil and that is fixed substantially coaxially with said iron core on said fixed section of said first one of said connectors.

7. The electromagnetic detachable connector arrangement according to claim 6, wherein said annular permanent magnet is magnetized in a radial direction relative to a center axis of said iron core.

8. The electromagnetic detachable connector arrangement according to claim 6, wherein a second one of said connectors other than said first connector further includes a second electromagnet that comprises a coil wound around an iron core and that is fixed to said movable section of said second connector, and a second annular permanent magnet that is arranged to surround said coil of said second electromagnet, said iron cores of said first and second electromagnets are rod iron cores and are arranged coaxial with each other, and said first and second permanent magnets are magnetized so as to generate a magnetic attraction therebetween.

9. The electromagnetic detachable connector arrangement according to claim 6, wherein a second one of said connectors other than said first connector further includes a second electromagnet that comprises a coil wound around an iron core and that is fixed to said movable section of said second connector, and a second annular permanent magnet that is arranged to surround said coil of said second electromagnet, said iron cores of said first and second electromagnets are rod iron cores and are arranged coaxial with each other, said first and second permanent magnets are respectively magnetized in directions opposite to each other so as to generate a magnetic attraction between said iron cores of said first and second electromagnets, and a connection between said movable sections in a connected state is maintained by said magnetic attraction between said iron cores.

10. The electromagnetic detachable connector arrangement according to claim 7, wherein a second one of said connectors other than said first connector further includes a second electromagnet that comprises a coil wound around an iron core and that is fixed to said movable section of said second connector, and a second annular permanent magnet that is arranged to surround said coil of said second electromagnet, said iron cores of said first and second electromagnets are rod iron cores and are arranged coaxial with each other, and said first and second permanent magnets are magnetized radially and so as to generate a magnetic attraction therebetween.

11. The electromagnetic detachable connector arrangement according to claim 7, wherein a second one of said connectors other than said first connector further includes a second electromagnet that comprises a coil wound around an iron core and that is fixed to said movable section of said second connector, and a second annular permanent magnet that is arranged to surround said coil of said second electromagnet, said iron cores of said first and second electromagnets are rod iron cores and are arranged coaxial with each other, and said first and second permanent magnets are respectively magnetized radially and in directions opposite to each other, and are arranged so that a magnetic flux from said permanent magnets is respectively concentrated within said iron cores to generate a magnetic attraction between said iron cores, and a connection between said movable sections in a connected state is maintained by said magnetic attraction between said iron cores.

12. The electromagnetic detachable connector arrangement according to claim 1, further comprising a resilient force applying element exerting a biasing force onto one of said movable sections in a direction releasing a connection between said movable sections.

* * * * *